US006404090B1

(12) United States Patent
Phillips et al.

(10) Patent No.: US 6,404,090 B1
(45) Date of Patent: Jun. 11, 2002

(54) APPARATUS FOR OBTAINING CERTAIN CHARACTERISTICS OF AN ARTICLE

(75) Inventors: Peter Phillips, St Ives; Norman Raymond Malzard, Seven Hills; Nikola Korecki, Cronulla; Alexander Baitch, Baulkham Hill, all of (AU)

(73) Assignee: Microsystem Controls Pty LTD, Victoria (AU)

( * ) Notice: Subject to any disclaimer, the term of this patent is extended or adjusted under 35 U.S.C. 154(b) by 0 days.

(21) Appl. No.: 09/029,038

(22) PCT Filed: Aug. 23, 1996

(86) PCT No.: PCT/AU96/00530

§ 371 (c)(1),
(2), (4) Date: Jan. 18, 1999

(87) PCT Pub. No.: WO97/08664

PCT Pub. Date: Mar. 6, 1997

(30) Foreign Application Priority Data

Aug. 23, 1995 (AU) ..... PN4952

(51) Int. Cl.[7] ..... G07D 5/08

(52) U.S. Cl. ..... 310/166; 194/318; 324/207.17; 324/239; 324/243

(58) Field of Search ..... 310/49 R, 216, 310/254, 40 MM, 162–164, 193, 184, 218; 29/596–598; 324/207.17, 236–239, 243

(56) References Cited

U.S. PATENT DOCUMENTS

| | | | | |
|---|---|---|---|---|
| 1,953,414 A | | 4/1934 | Klose | 194/101 |
| 2,390,147 A | * | 12/1945 | Hatton | 194/317 |
| 2,912,767 A | | 11/1959 | Mittelmann | 310/206 |
| 3,390,310 A | * | 6/1968 | Peterson | 194/317 |
| 4,103,191 A | * | 7/1978 | Kawamura et al. | 310/49 R |
| 4,329,601 A | * | 5/1982 | Mai | 310/49 R |
| 4,503,346 A | * | 3/1985 | Bertram et al. | 310/49 R |
| 4,554,471 A | * | 11/1985 | Bertram et al. | 310/49 R |
| 4,556,140 A | | 12/1985 | Okada | 194/4 C |
| 4,782,353 A | * | 11/1988 | Ogihara et al. | 396/463 |
| 4,786,834 A | * | 11/1988 | Grant et al. | 310/194 |
| 4,950,986 A | * | 8/1990 | Guerrero | 324/207.19 |
| 4,998,610 A | * | 3/1991 | Said et al. | 194/318 |
| 5,078,252 A | * | 1/1992 | Furuya et al. | 194/318 |

(List continued on next page.)

FOREIGN PATENT DOCUMENTS

| | | |
|---|---|---|
| DE | 543 039 | 1/1932 |
| DE | 735 052 | 5/1943 |
| DE | 875 237 | 4/1953 |
| DE | 970 599 | 10/1958 |
| DE | 486 078 | 3/1970 |
| DE | 1 930 345 | 12/1970 |
| DE | 2 120 287 | 11/1971 |
| DE | 1 296 484 | 11/1972 |
| DE | 2 149 265 | 5/1973 |
| GB | 104 777 | 8/1938 |

OTHER PUBLICATIONS

Patent Abstracts of Japan, E 77, p. 2227, JP, 52–24593 A (KUBOTA TEKKO K.K.) Feb. 24, 1977, Abstract.

Patent Abstracts of Japan, P 434, p. 91, JP, 60–201247 A (GUROORII KOGYO K.K.) Oct. 11, 1985.

International Search Report, Nov. 1, 1996, 4 pages (Note: The Prior–Art of International Search is Listed and Submitted by the Supplemental IDS Filed on Mar. 2, 2000).

*Primary Examiner*—Tran Nguyen
(74) *Attorney, Agent, or Firm*—Banner & Witcoff, Ltd.

(57) ABSTRACT

Apparatus for obtaining certain characteristics of an article (60, 62), the apparatus including an electromagnet inductor (10, 30) with a first end (20, 54) and a second end (20, 54) with an air gap (24, 58) therebetween, there being at least one arm (12, 32, 34) joining the first end (20) and the second end (20) having electrical windings (14, 52) to generate a magnetic flux in the air gap (24, 58), the arm (12, 32, 34) being a fixed return path for the magnetic flux.

26 Claims, 4 Drawing Sheets

U.S. PATENT DOCUMENTS 5,263,566 A * 11/1993 Nara et al. ..... 194/318
5,293,980 A * 3/1994 Parker ..... 194/317
5,323,891 A * 6/1994 Waite ..... 324/236
5,502,359 A * 3/1996 Schemmann et al. . 310/40 MM
5,969,444 A * 10/1999 Kamitani ..... 310/49 R
6,056,105 A * 5/2000 Ohtomo ..... 194/319

* cited by examiner

APPARATUS FOR OBTAINING CERTAIN CHARACTERISTICS OF AN ARTICLE

FIELD OF THE INVENTION

This invention relates to apparatus for obtaining certain characteristics of an article and refers particularly, though not exclusively, to apparatus for determining the identifying characteristics of a coin.

Throughout this specification, reference to a coin is to be taken as including a reference to a token.

BACKGROUND OF THE INVENTION

In our earlier international applications PCT/AU91/00295 and PCT/AU94/00777 there are disclosed methods and apparatus for the discrimination of coins. These apparatus, like the apparatus of the prior art to which they refer, and the remainder of the prior art, use "pot-core" ferrites in which electrical windings are inserted. The use of such ferrites results in a complex magnetic field across the face of each ferrite. This is because the coils are in series electrically but are not connected magnetically. When a coin is inserted into the machine in which the apparatus is located, the coin rolls down, or falls, into the gap between the two ferrites. When a coin is in the gap, a complex magnetic field pattern is created. This results in changes in the eddy current losses being induced in the coin, and changes in the inductance of the magnetic circuit. The applications of a dc pulse as described in our earlier international application referred to above results in a specific coin signature which is able to be used to discriminate between coins of various dimensions, metals, and permeabilities. In this way, it is possible to discriminate between coins of different values.

It has been found that factors such as coin speed and, more particularly, the position of the coin within the air gap between the ferrites in such constructions is unpredictable. Furthermore, the dimensions of the air gap cannot be controlled with precision as the two ferrites are mounted on separate components as part of the construction of the apparatus. This may cause a variation in the width of the air gap due to manufacturing tolerances. Also, over time there may be movement of the ferrites to thus alter the width of the air gap. As a result, the coin signatures produced may have a large range of results for coins of the same value. In consequence, it is, at times, difficult to satisfactorily discriminate between certain coins.

Furthermore, the design of the sensor effects the extent of the induced eddy currents produced in a particular coin due to the way in which the coin interacts with the magnetic field imposed upon the coin.

It is therefore the principal object of the present invention to provide apparatus for obtaining certain characteristics of an article where a return magnetic path is provided. A further object is to provide apparatus for obtaining certain characteristics of an article where an air gap of relatively constant width is provided.

BRIEF DESCRIPTION OF THE INVENTION

With the above and other objects in mind, the present invention provides apparatus for obtaining certain characteristics of an article, the apparatus including an electromagnet inductor with a first end and a second end, the first end facing the second end with an air gap therebetween, there being at least one arm joining the first end and the second end and having electrical windings to generate magnetic flux in the air gap, the arm being a fixed return path for the magnetic flux; the first end and the second end each having a surface area substantially the same as or greater than the surface area of the article.

The windings may be mounted within the arm, or around the arm.

Preferably, the arm is C shaped with the gap being the air gap. Alternatively, the arm may be one arm of a number of arms which, in combination with the air gap, form a rectangle.

The arm may be rectangular, or be of any other shape such as, for example, circular, pear shaped, elliptical or tear shaped.

The ends may have end pieces of greater surface area than the surface area of the ends. The end pieces may be integral with the ends, or may be separate components securely attached to the ends. Preferably, the end pieces are round and are larger in diameter than the largest article to be processed.

DESCRIPTION OF THE DRAWINGS

The invention will now be described by way of non-limitative example only with reference to the accompanying illustrative drawings in which.

DESCRIPTION OF THE PREFERRED EMBODIMENTS

Figure 1:
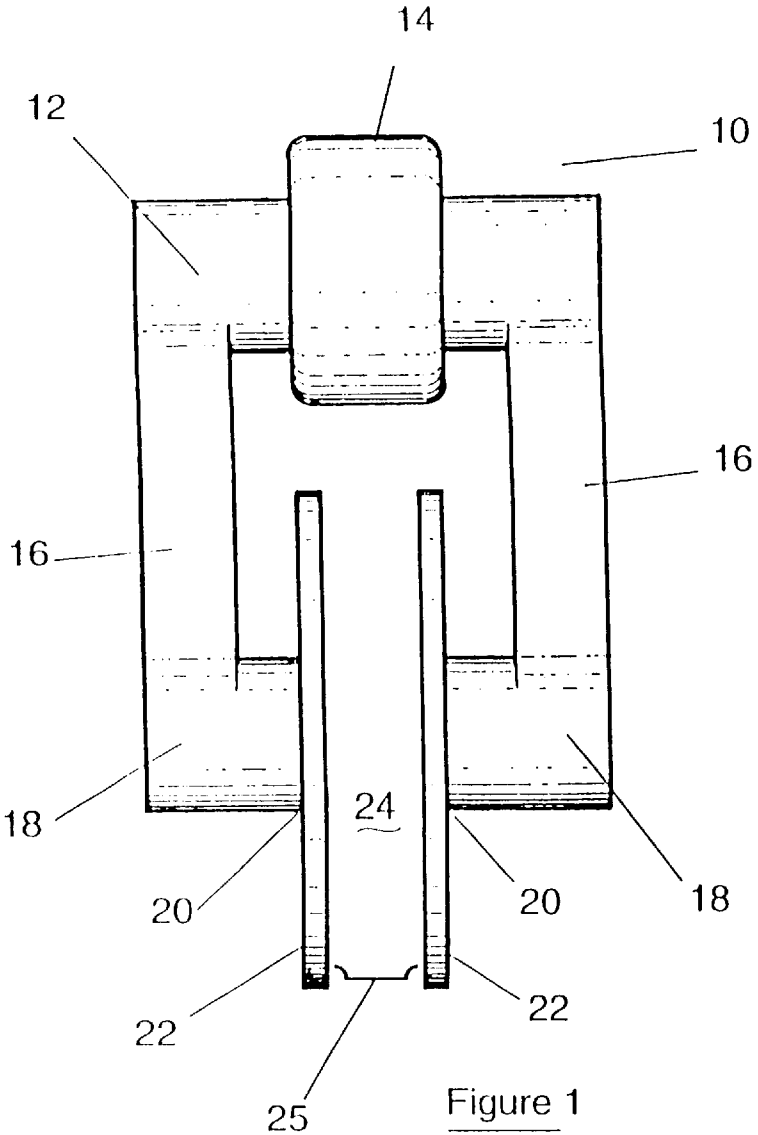
FIG. 1 is a front view of a first embodiment incorporating the principal features of the present invention.
Figure 2:
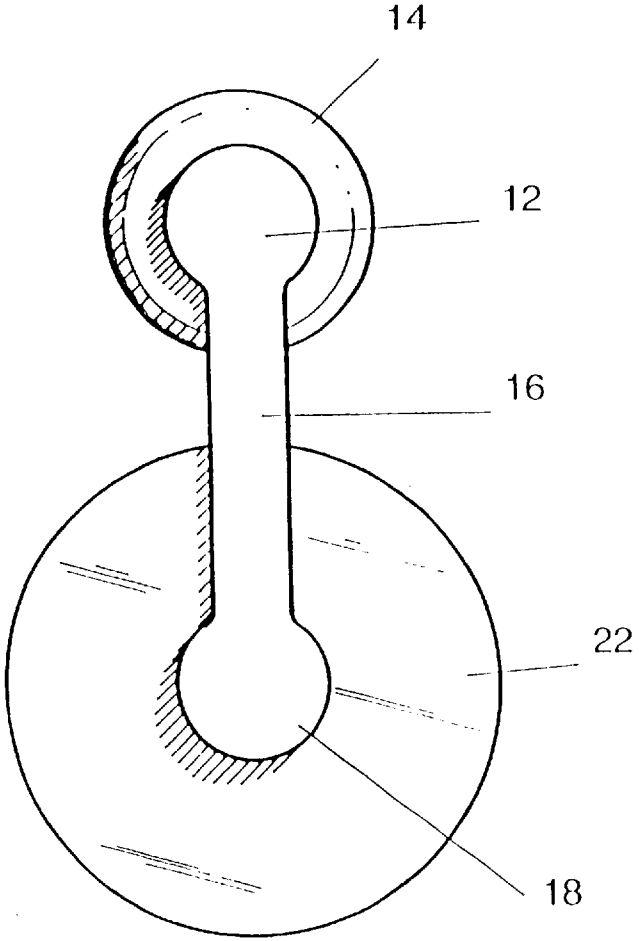
FIG. 2 is an end view corresponding to that of FIG. 1.

As shown in FIGS. 1 and 2 the drawings there is an electromagnet inductor generally designated 10 and which has a first arm 12 on which is located a winding assembly 14, the winding assembly being mounted on the arm 12 in the usual manner. Depending from and integral with arm 12 are two side arms 16. At the lowermost ends of side arms 16 and integral therewith are end arms 18, each having an end 20 to which is mounted an enlarged end piece 22. Between end pieces 22 is an air gap 24.

The electromagnet inductor 10, being the combination of arm 12, side arms 16, and end arms 18, forms a solid and consistent return path for the magnetic flux.

Also, by having end pieces 22 larger than ends 20, the magnetic field in the air gap is substantially, relatively constant. With the enlarged surface area of end pieces 22, a coin travelling through, or stationary in, the air gap 24, either partially or totally, may be sufficiently detected for discrimination to occur.

Arm 12, as well as the side arms 16 and end arms 18, is shown as being circular It may be square, oblong, elliptical, rectangular, triangular, trapezoidal, pentagonal or any other suitable or desired shape. End pieces 22 may be of any suitable or desired shape. The relative dimensions and lengths of arm 12, side arms 16, end arms 18 and end pieces 22 may be varied as desired, although end pieces 22 should be of greater area than ends 20. Preferably, the end pieces 22 are of substantially greater area than ends 20, as is illustrated. Side arms 16 should be spaced apart by a distance greater than the width of air gap 24 to reduce flux leakage outside the air gap 24.

The electromagnet inductor 10 illustrated is rectangular. It may be circular, ovular, C-shaped or any other suitable or required shape. The material of arms 18, side arms 16, end arms 18 and end pieces 22 may be as required such as, for example, material of high permeability such as ferrite.

The enlarged surface area of end pieces 22, the relative consistency of the magnetic field in air gap 24, and the consistency of the magnetic path in electromagnet inductor 10, all assist in providing greater accuracy in determining the characteristics of any article in air gap 24 irrespective of its position in the airgap 24. A rail or the like 25 is provided to enable articles to pass between end pieces 22 and within the air gap 24. For reliability of operation, the rail 25 should be located within air gap 24 so that any movement or bounce of the article is within air gap 24.

Furthermore, with inductor 10 being preferably made as a one-piece article, or in several pieces securely held together as in by bolts or the like, the dimensions of air gap 24 remain relatively constant. As a result, the characteristics determined of a particular article may be relatively constant from one apparatus to another, all other aspects being equal. Therefore, the magnetic field in the air gap 24 will be relatively constant. As the flux lines extend between and perpendicular to the end pieces 22, the magnetic field will also be relatively uniform. This allows for a more consistent and reliable result when coins pass between end pieces 22, and are tested irrespective of the angle of the coin relative to the end pieces 22 and height above rail 25. Furthermore, the dynamic range of the inductor 10 is increased so that a larger range of coins having similar characteristics can be reliably discriminated.

However, by having the coil 14 around arm 12, the inductor 10 may be more sensitive to metal in the apparatus in which inductor 10 is located. This may be in the housing, frame-work, or external cover. The presence of metal may therefore effect the reliability of the results obtained.

To refer now to FIGS. 3 to 7, there is shown an alternative embodiment which is of an electromagnet inductor generally designated 30 and which has a first arm 32, a second arm 34, and a linking member 36. Each arm 32, 34 has a substantially circular main body portion 42, 44 respectively with there being a connecting portion 46, 48 respectively of significantly reduced surface area. The two arms 32, 34 have linking portions 38, 40 which co-operate with linking member 36 to form top arm 50. In this way, there is a continuous return magnetic path for the magnetic flux from arm 32 through top arm 50 to arm 34, and vice versa. The joining of linking portions 38, 40 and link 36 may be effected by use of bolt 51 passing through linking portions 38, 40 and link 36.

A coil 52 is located in a recess 53 in each arm 32, 34. The cores 54 may be integral with the bodies 42, 44 and will be of the same material as the bodies 42, 44, which is preferably a magnetic material such as a soft ferrite. In this way cores 54 will operate as the cores of the electromagnet. Each core 54 is preferably circular in shape, although other shapes may be used. An air gap 58 between arms 32, 34 is provided and through which can pass the coins or other articles.

Notches 56 are provided on each side of body 44, as well as body portion 42, to allow coin entry detector 55 and trigger 57 detectors to be located therein. Although only one of each detector is shown, there may be a plurality of either or both. For either, if there is a plurality, they may be operated simultaneously or sequentially or at predetermined time intervals.

By having a coil 52 in each arm 32, 34, when each coil 52 is activated the magnetic flux will follow the line of least magnetic resistance and thus pass through body 44, connecting portion 48, linking portion 40, link member 36, linking portion 38, connecting portion 46, to body 42. Naturally, the reverse may also occur depending upon the electrical connections. This will provide a uniform perpendicular magnetic field across the air gap 58 concentrated between the closest opposing faces of the end pieces. However, there will be minimal leakage of magnetic flux outside the electromagnet inductor 30. Also, by having coils 52 embedded within arms 32, 34 the inductor 30 may be far less sensitive to the presence of metal in the apparatus in which the inductor 30 is located. Coils 52 may be electrically connected in series or parallel, or may be electrically connected independently to allow for independent or sequential operations. However, they are magnetically connected to provide the return path for magnetic flux.

Also, by having two arms with a separate coil in each arm, one core may effectively operate as the "north" pole and the other operate as the "south" pole to thus provide a magnetic path through magnetic material to join the north and south poles, as well as a concentrated, and relatively uniform, magnetic field in the air gap between the north and south poles. With the surrounding magnetic material, the loss of flux to the atmosphere and through indirect leakage, other than across the air gap, is minimised.

Figure 7:
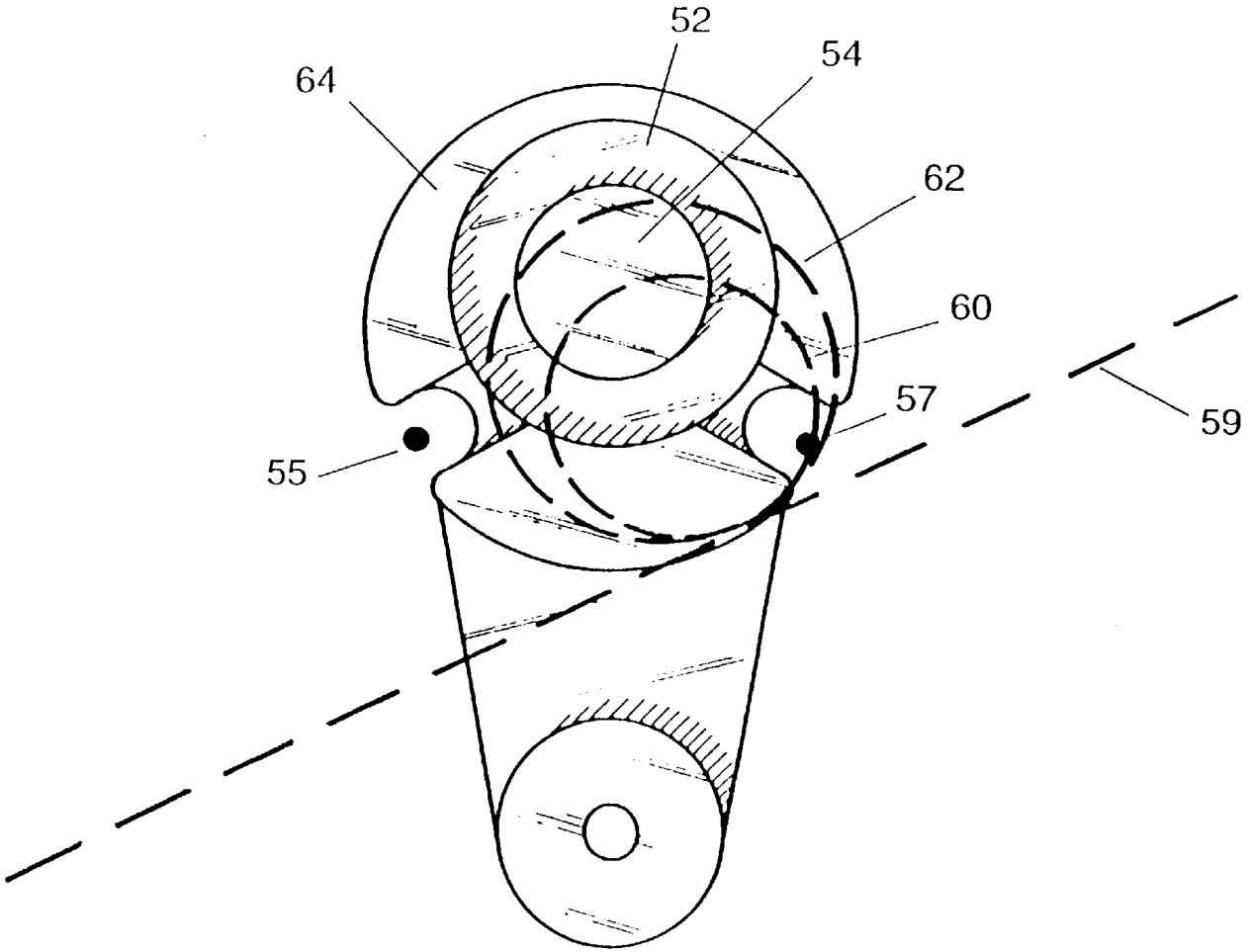
FIG. 7 is a side view of the arm of the embodiment of FIG. 3 showing a coin rail and coins.

As is clear from FIG. 7, where a coin rail is designated as 59, coins 60, 62 of different diameter can roll along the coin rail 59 and they will pass in front of rim 64, coil 52, and core 54, irrespective of the size of the coin.

Figure 3:
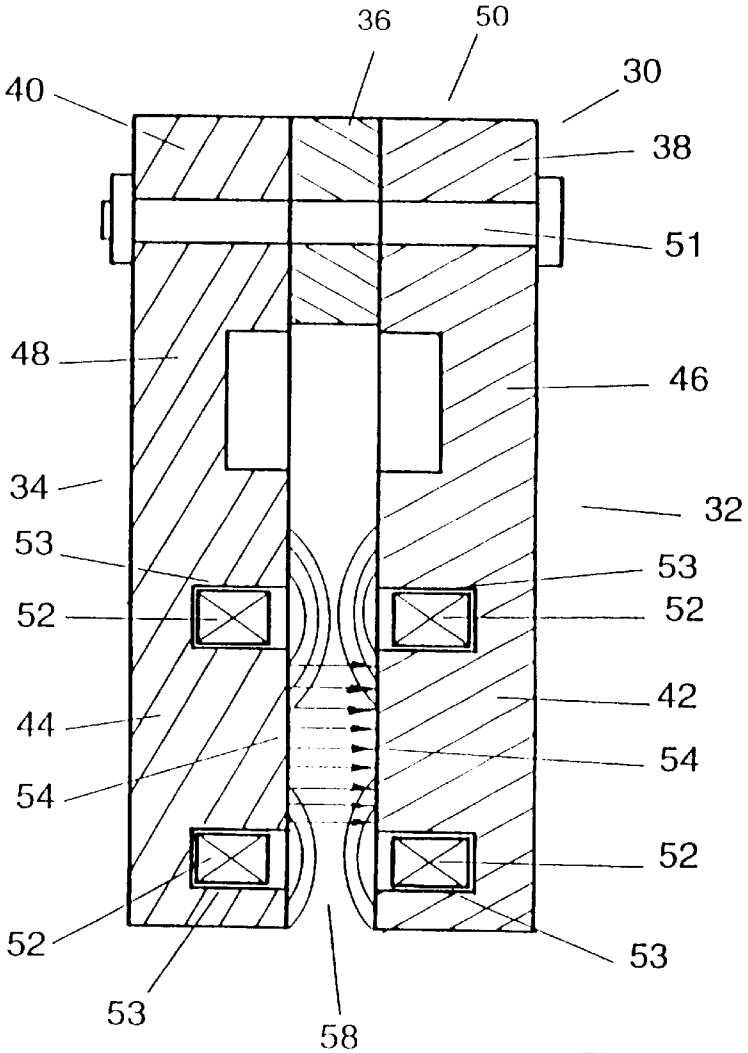
FIG. 3 is a vertical cross-sectional view of an alternative embodiment.

As can be seen from FIG. 3, the flux path across the air gap is generally perpendicular to the arms 34. However, tangential flux lines are also created between rim 64 and core 54. Tests have shown that as a smaller coin 60 rolls along a rail 59, the magnetic induction of coin 60 commences as soon as part of the coin overlaps rim 64. At this time, the flux is perpendicular to the rim 64. For a larger diameter coin 62, the result is the same. As more of the coins 60, 62 overlap the rim 64, the magnetic induction of the coins 60, 62 increases, at a relatively slow rate. As the coin commences to overlap the core 54, the magnetic induction in the coin 60, 62 increases significantly. Also, the nature of the flux changes in that not only is the perpendicular flux being induced into the coin, but also the tangential flux commences to be induced into the coin. When in the position shown, there is complete saturation of the coins 60, 62. In that way, the characteristics of the coins 60, 62 can be determined far more reliably due to the intensity of the magnetic field in the air gap 58, and the saturation of the coin when at the centre of the core 54. In this way, if the location of trigger point 57 is known, the timing of the magnetic pulse induced into the coins 60, 62 can be achieved accurately such that sufficient magnetic saturation of the coins 60, 62 will occur. The decay curve can then be read accurately whilst the coin is still within the air gap 58. This provides for far more reliability in determining the characteristics required of coins 60, 62.

In this way, more accurate results can be obtained.

As coins 60, 62 pass along rail 59 through air gap 58, the operation of the inductor 30 is independent of the speed of the coin as a single pulse is applied at the trigger point 57. There is a geometric relationship between the rail 59, trigger 57 and the magnetic field in gap 50. For variations in coin diameter, more or less metal enters the field. As the field is complex there are differing amounts of the coin in different parts of the field, thus providing different results. Therefore, the inductor 30 is more sensitive to certain coin diameters as the coin passes from one region of air gap 58 to another.

However, if the diameter of the coin is sufficiently large so that when in the position shown in FIG. 7 the coin fully overlaps the core 54 the saturation of the coin is almost complete. It is only if the coin overlaps the rim 64 opposite trigger 57 that further saturation can occur. Therefore, for large diameter coins, the ability to discriminate is lessened.

Figure 8:
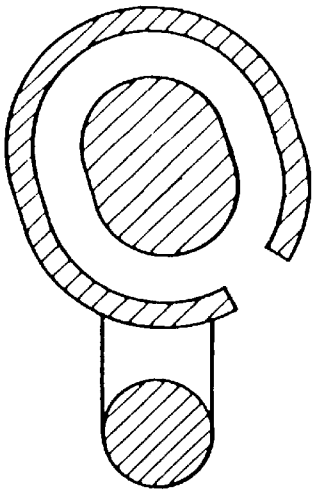
FIG. 8 is a schematic illustration of a final embodiment.
Figure 4:
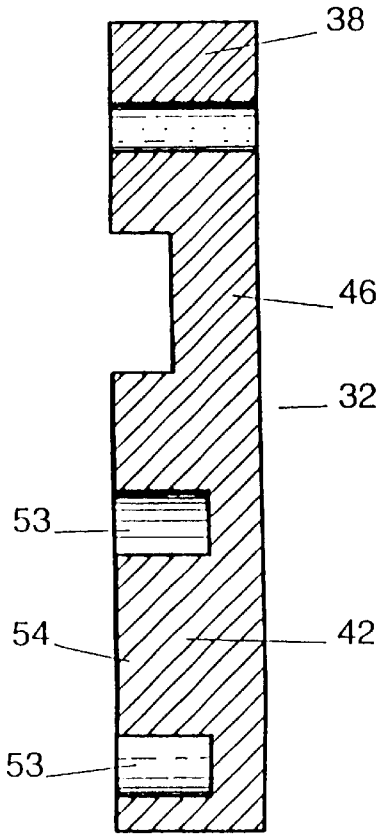
FIG. 4 is a vertical cross-sectional view of one arm of the embodiment of FIG. 3.
Figure 5:
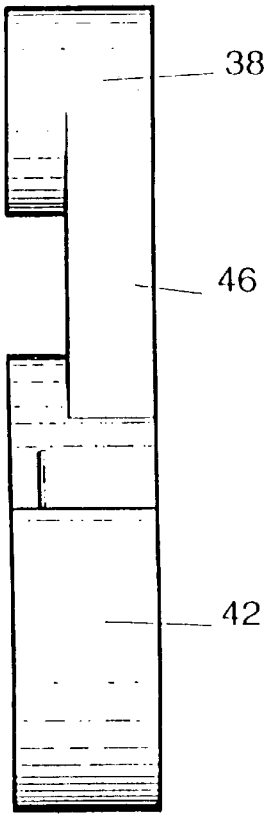
FIG. 5 is a side view of the arm of FIG. 4.
Figure 6:
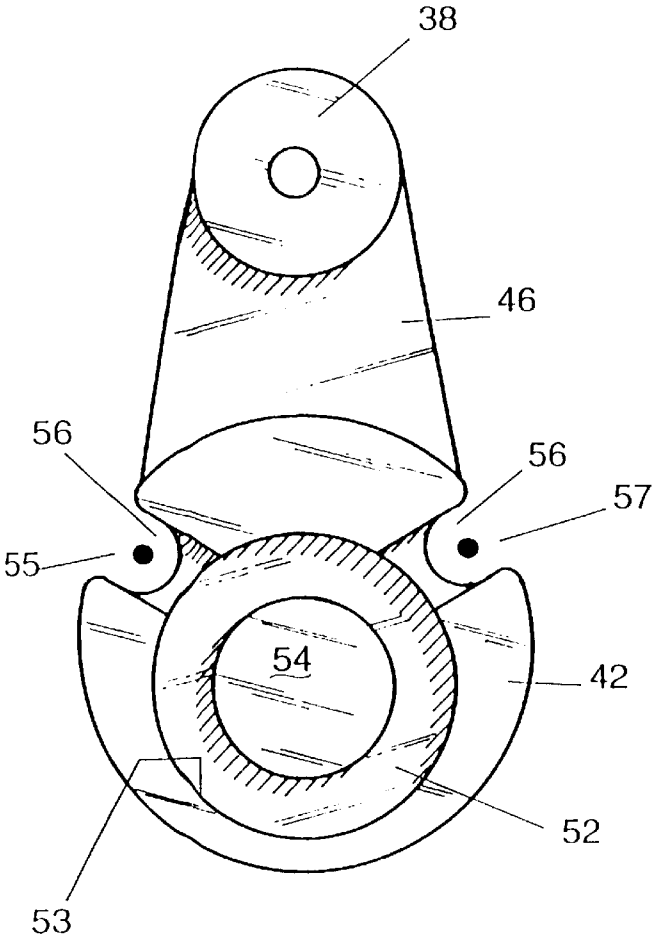
FIG. 6 is a front view of the arm of FIGS. 4 and 5.

As can be seen from FIG. 7, the increase in diameter of coins 60, 62 causes an increase in overlap with core 54 in a direction determined by the geometric relationship between the rail 59 and the trigger point 57. As shown, it is almost perpendicular to rail 59. However, if trigger point 57 were higher above rail 59, the angle would be quite different. Therefore, by increasing the dimension of core 54 in that direction alone, the ability to discriminate between large diameter coins is increased. This is shown schematically in FIG. 8. In all other respects, the operation of the embodiment of FIG. 8 is the same as that of the other embodiments.

Therefore, more information about the coin being tested can be obtained. However, it makes the inductor more sensitive to coin position in the air gap as the magnetic field is not uniform across or along the gap.

Whilst there has been described in the foregoing description preferred constructions of apparatus for determining certain characteristics of an article, it will be realised by those skilled in the technology that many variations or modifications in details of design in construction may be made without departing from the present invention.

It will be understood that the invention disclosed and defined herein extends to all alternative combinations of two or more of the individual features mentioned or evident from the text or drawings. All of these different combinations constitute various alternative aspects of the invention.

It will also be understood that where the term "comprises" or its grammatical variants, is employed herein, equivalent to the term "includes" and is not to be taken as excluding the presence of other elements or features.

The claims defining the invention are as follows:

1. A coin validation device suitable for use in discriminating coins on the basis of measured magnetic field characteristics caused by a coin passing through a magnetic field generated by the device, the device having a sensor including:

an electromagnet inductor with a first end and a second end, said first end facing said second end with an air gap therebetween;

at least one arm joining said first end and said second end, said at least one arm having at least one electrical winding to generate a magnetic flux and form a magnetic field across said air gap, said arm providing a return path for said magnetic flux;

said at least one electrical winding providing a generally uniform magnetic field across said air gap so that a coin subsequently passing through said air gap is exposed to a substantially uniform magnetic field to assist in improving discrimination between coins, wherein said first end and said second end each has an end piece with a surface area greater than the surface area of said first and second ends.

2. A device as claimed in claim 1, wherein said at least one electrical winding is a plurality of electrical windings.

3. A device as claimed in claim 2, wherein said arm is C-shaped.

4. A device as claimed in claim 2, wherein said at least one arm is one of a number of arms which, in combination with said air gap, form a rectangle.

5. A device as claimed in claim 2, wherein said windings are mounted around said arm.

6. A device as claimed in claim 2, wherein said at least one arm is two spaced apart and substantial parallel arms, each arm having at least one of said windings.

7. A device as claimed in claim 6, wherein said windings are mounted in and respectively form part of said end-pieces at said first end and said second end.

8. A device as claimed in claim 7, wherein said windings have a core which is integral with said arm.

9. A device as claimed in claim 8, wherein said windings and said core are concentric.

10. A device as claimed in claim 5, wherein said magnetic field in said air gap is substantially uniform.

11. A method of validating a coin on the basis of measured field characteristics generated by a coin passing through a magnetic field, the method including the steps of passing a coin through a generally uniform magnetic field and determining magnetic field characteristics of the coin, wherein said generally uniform magnetic field is provided by a device as claimed in claim 1.

12. A device as claimed in claim 1, wherein said arm has a cross-sectional shape which is selected from one of rectangular, circular, pear-shaped, elliptical, or tear-shaped.

13. A device as claimed in claim 1, wherein said end pieces are substantially identical in shape.

14. A device as claimed in claim 13, wherein the cross-sectional areas of said first and second ends are substantially identical.

15. A device as claimed in claim 13, wherein said end pieces are mounted on said first and second ends.

16. A device as claimed in claim 1, wherein said end pieces are integral with said first and second ends.

17. A method of validating a coin on the basis of measured magnetic field characteristics generated by a coin passing through a magnetic field, the method including the steps of passing a coin through a generally uniform magnetic field and determining magnetic field characteristics of the coin, wherein said generally uniform magnetic field is provided by a device as claimed in claim 1.

18. A coin validation device suitable for use in discriminating coins on the basis of measured magnetic field characteristics caused by a coin passing through a magnetic field generated by the device, the device having a sensor including:

an electromagnet inductor with a first end and a second end, said first end facing said second end with an air gap therebetween;

at least one arm joining said first end and said second end, said at least one arm having at least one electrical winding to generate a magnetic flux and form a magnetic field across said air gap, said arm providing a return path for said magnetic flux;

said at least one electrical winding providing a generally uniform magnetic field across said air gap so that a coin subsequently passing through said air gap is exposed to a substantially uniform magnetic field to assist in improving discrimination between coins, wherein said at least one electrical winding is a plurality of electrical windings, wherein said windings are mounted within said arm.

19. A device as claimed in claim 18, wherein said windings have a core which is integral with said arm.

20. A device as claimed in claim 19, wherein said windings and said core are concentric.

21. A device as claimed in claim 19, wherein said core is elliptical.

22. A device as claimed in claim 18, wherein said magnetic field in said air gap is a compound magnetic field including flux lines perpendicular to said first and second ends, and tangential flux lines.

23. A device as claimed in claim 18, wherein said windings are electrically connected in one of the following ways:

(i) series;

(ii) parallel;

(iii) independently.

24. A device as claimed in claim 18, wherein said arm is C-shaped.

25. A device as claimed in claim 18, wherein said at least one arm is one of a number of arms which, in combination with said air gap, form a rectangle.

26. A device as claimed in claim 2, wherein said device includes means to operate said windings simultaneously or sequentially at multiple trigger points or predetermined time intervals.

* * * * *